US008053708B2

(12) United States Patent
Fisher

(10) Patent No.: US 8,053,708 B2
(45) Date of Patent: Nov. 8, 2011

(54) USER-CONFIGURABLE INTERFACE FOR A COOKING APPLIANCE

(75) Inventor: Gary W. Fisher, Goodletsville, TN (US)

(73) Assignee: Electrolux Home Porducts, Inc., Charlotte, NC (US)

( * ) Notice: Subject to any disclaimer, the term of this patent is extended or adjusted under 35 U.S.C. 154(b) by 1226 days.

(21) Appl. No.: 11/558,496

(22) Filed: Nov. 10, 2006

(65) Prior Publication Data

US 2008/0110875 A1 May 15, 2008

(51) Int. Cl.
*H05B 3/68* (2006.01)
*H05B 3/02* (2006.01)

(52) U.S. Cl. ..... 219/448.12; 219/462.1; 219/483

(58) Field of Classification Search .... 219/443.1–468.2, 219/476–483
See application file for complete search history.

(56) References Cited

U.S. PATENT DOCUMENTS 3,974,472 A * 8/1976 Gould, Jr. ..... 345/211
4,121,204 A * 10/1978 Welch et al. ..... 345/174
4,371,780 A 2/1983 Gossler et al.
4,527,049 A * 7/1985 Thomas et al. ..... 219/446.1
5,274,209 A * 12/1993 Edamura ..... 219/714
5,321,229 A 6/1994 Holling et al.
5,572,205 A 11/1996 Caldwell et al.
6,198,080 B1 3/2001 Rice et al.
6,255,629 B1 7/2001 Supper et al.
6,255,630 B1 7/2001 Barnes et al.
6,664,519 B2 12/2003 Hammelsbacher et al.
6,693,262 B2 2/2004 Gerola et al.
6,858,821 B2 2/2005 Arnold
6,924,465 B2 8/2005 Schilling et al.
6,930,287 B2 8/2005 Gerola et al.
6,933,477 B2 8/2005 Becker et al.
7,247,821 B2 * 7/2007 Wilsdorf ..... 219/506
2002/0190057 A1 12/2002 Staebler et al.
2004/0007566 A1 1/2004 Staebler et al.
2004/0200822 A1 10/2004 Boyer
2004/0200824 A1 10/2004 Boyer et al.
2005/0078027 A1 4/2005 Philipp

* cited by examiner

*Primary Examiner* — Sang Paik
(74) *Attorney, Agent, or Firm* — Pearne & Gordon LLP

(57) ABSTRACT

A cooking appliance includes a plurality of heating elements and a plurality of user interface devices for receiving heating element settings. An input device for allows a user to arbitrarily selectively associate any one or more of the heating elements with any one or more of the user interface devices.

25 Claims, 3 Drawing Sheets

USER-CONFIGURABLE INTERFACE FOR A COOKING APPLIANCE

BACKGROUND OF THE INVENTION

1. Field of the Invention

The present invention relates to user-configurable controls for a cooking appliance having heating elements, such as cooktop and oven heating elements.

2. Description of Related Art

Conventional controls for cooktop and oven heating elements utilize switches, pushbuttons, indicator lights, potentiometers, and/or electronic controls. Controls are typically provided for controlling separate heating elements, such as separate cooktop heating elements. Controls may be provided for simultaneously controlling multiple heating elements. It would be useful if a single interface device or multiple interface devices could be selectively associated with one or more heating elements.

BRIEF SUMMARY OF THE INVENTION

In accordance with one aspect, the present invention provides a cooking appliance. The cooking appliance includes a plurality of heating elements and a plurality of user interface devices for receiving heating element settings. An input device for allows a user to arbitrarily selectively associate any one or more of the heating elements with any one or more of the user interface devices.

In accordance with another aspect, the present invention provides a cooking appliance. The cooking appliance includes a first heating element and a second heating element. The system further includes a first user interface device for receiving a first heating element setting from a user and a second user interface device for receiving a second heating element setting from the user. A controller selectively associates any one or both of the first heating element and the second heating element with any one or both of the first user interface device and the second user interface device based on an arbitrary selection by the user. An indicator indicates a selective association of any one or both of the first heating element and the second heating element with any one or both of the first user interface device and the second user interface device.

In accordance with another aspect, the present invention provides a cooktop heating system. The system includes a first cooktop heating element, a second cooktop heating element, a third cooktop heating element and a fourth cooktop heating element. A user interface device receives a heating element setting from a user. A controller selectively associates the user interface device with any one or more of the first cooktop heating element, the second cooktop heating element, the third cooktop heating element, and the fourth cooktop heating element based on an arbitrary user selection. An indicator indicates a selective association of the user interface device with any one or more of the first cooktop heating element, the second cooktop heating element, the third cooktop heating element, and the fourth cooktop heating element.

In accordance with another aspect, the present invention provides a method of configuring a heating element control system. The method includes the steps of providing a plurality of heating elements, providing a user interface device for receiving a heating element setting from a user, selectively associating the user interface device with any one or more of the heating elements based on an arbitrary selection by the user, and indicating a result of the step of selectively associating.

DESCRIPTION OF AN EXAMPLE EMBODIMENT

Figure 1:
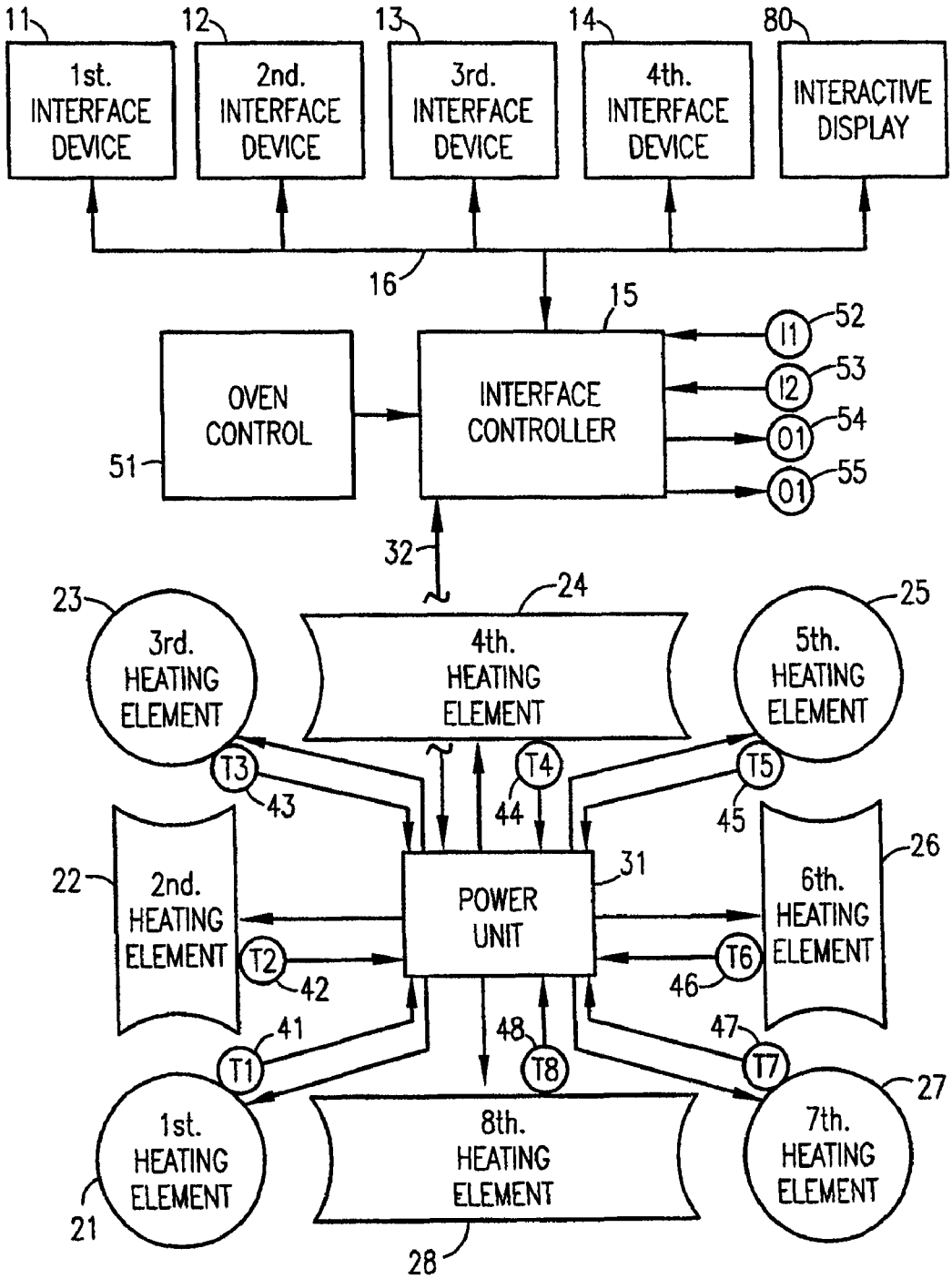
FIG. 1 is a schematic diagram illustrating a power control system for heating elements according to the present invention.

FIG. 1 provides a schematic illustration of an example heating element power control system including multiple user interface devices and multiple heating elements, according to one embodiment of the present invention. The example power control system includes a first interface device 11, a second interface device 12, a third interface device 13, a fourth interface device 14, and an interactive display 80.

Each interface device 11-14 and the interactive display 80 can include one or more electronic interface devices for inputting and/or outputting, displaying, or audibly broadcasting information, such as instructions, set points, miscellaneous system conditions and system configuration information. Examples of such instructions, set points, system conditions, and system configuration information can include a desired heating element power setting, current heating element temperature, a hot cooktop warning, and a heating element control configuration. Examples of electronic interface devices include, but are not limited to, membrane switches, capacitive or touch switches, infinite switches, multi-segment light emitting diode (LED) displays, touch-screen displays, liquid crystal displays (LCDs), plasma displays, vacuum fluorescent displays (VFDs), and the like.

Each interface device 11-14 and the interactive display 80 can also include one or more discrete devices, such as toggle switches, pushbuttons, multiple position rotary switches, discrete LEDs, incandescent lights, and the like. Furthermore, each interface device 11-14 and the interactive display 80 can also include one or more analog devices, such as potentiometers and analog meters, for example. In addition, each interface device 11-14 and the interactive display 80 can include a combination of one or more electronic interface devices, discrete interface devices, and analog interface devices. Interface devices 11-14 and the interactive display 80 may be located locally near the heating elements or remotely. In FIG. 1, four interface devices and one interactive display are shown. However, the power control system of the present invention is not limited to four interface devices or limited to one interactive display, and fewer or greater than four interface devices and one interactive display may be provided.

An interface controller 15 communicates with and/or monitors the interface devices 11-14 and the interactive display 80. Communication wiring 16 is provided between the interface controller 15, the interface devices 11-14 and the interactive display 80. Communication wiring can include a digital communication line and/or a plurality of control and instrumentation conductors, depending on the composition of the interface devices 11-14 and the interactive display 80. The interface controller 15 monitors user-inputted information and controls output information for the interface devices 11-14 and the interactive display 80.

The power control system of the present invention controls power to one or more electric heating elements, such as cooktop heating elements, oven heating elements (for example, bake and broil elements), and warmer drawer heating elements. FIG. 1 shows a first heating element 21, a second heating element 22, a third heating element 23, a fourth heating element 24, a fifth heating element 25, a sixth heating element 26, a seventh heating element 27, and an eighth heating element 28. However, the power control system is not limited to controlling eight heating elements, and fewer or greater than eight heating elements may be provided. In FIG. 1, the heating elements 21-28 are schematically shown as cooktop heating elements. However, it is to be appreciated that the present invention is not limited to cooktop heating elements and controls for cooktop heating elements, and that other heating elements, for example, bake elements, broil elements, and warmer drawer elements, are within the scope of the invention.

In an embodiment of the present invention, the heating elements 21-28 include electrical resistance heating elements. In another embodiment, the heating elements 21-28 include electrical induction heating elements.

A power unit 31 controls power output to the heating elements 21-28. The power unit 31 includes a plurality of switches, for example relays, transistors, thyristors, silicon controlled rectifiers, and the like, for controlling power output to the heating elements. When the power unit 31 causes a switch or switches for a particular heating element to be closed, power is provided to the heating element. Conversely, when the power unit 31 causes a switch or switches for a particular heating element to be opened, power ceases to be supplied to the element.

A communications bus 32 allows for bi-directional communications between the interface controller 15 and the power unit 31. Over the communications bus 32, the interface controller 15 can provide information to the power unit 31 regarding the operation of the heating elements, such as instructions regarding heating element power level, runtime, and the like. The interface controller 15 can also receive information from the power unit 31, such as status information regarding the heating elements 21-28, for example, on/off and current temperature. Because the interface controller 15 communicates with and/or monitors the interface devices 11-14 and the interactive display 80, and communicates with the power unit 31, information regarding the heating elements 21-28 and control of the heating elements 21-28 can be provided to a system user. For example, the user can input one or more heating element settings at an interface device for control of one or more heating elements.

The interface controller 15 and power unit 31 each include a processor, for example, a microprocessor, for carrying out programmed instructions. In one embodiment, the interface controller 15 and power unit 31 include separate processors. In another embodiment, the interface controller 15 and power unit 31 utilize a single processor, and the communications bus 32 between the interface controller 15 and power unit 31 is unnecessary.

The power unit 31 monitors the temperature of each heating element 21-28 through a temperature sensor located at each heating element 21-28. FIG. 1 shows a first temperature sensor 41, a second temperature sensor 42, a third temperature sensor 43 a fourth temperature sensor 44, a fifth temperature sensor 45, a sixth temperature sensor 46, a seventh temperature sensor 47, and an eighth temperature sensor 48 located at heating elements 21-28, respectively. Temperature information obtained from the temperature sensors 41-48 can be displayed at the interface devices 11, 12, 13, 14, or used by program control algorithms of the interface controller 15 and/or power unit 31. The temperature sensors 41-48 can include such devices as thermocouples or thermistors, for example. The power unit 31 and/or interface controller 15 can also monitor ambient temperature through an additional temperature sensor or sensors (not shown). The power unit 31 and/or interface controller 15 can be programmed to control an auxiliary device based on measured ambient temperature, such as energizing control relay to start a fan when the ambient temperature exceeds a desired level.

As stated above, the interface controller 15 communicates with and/or monitors the interface devices 11-14 over communication wiring 16. The interface controller 15 is programmed to selectively associate any one or more interface devices 11-14 with any one or more heating elements 21-28. This is possible because the interface devices 11-14 are not directly connected to the heating elements 21-28. The interface devices 11-14 are directly connected to the interface controller 15, which communicates with the power unit 31 over the communications bus 32. The power unit 31 controls power output to the heating elements 21-28. Accordingly, through communications with the power unit 31, the interface controller 15 can selectively associate any one or more interface devices 11-14, and, therefore, their respective input and output information, with any one or more heating elements 21-28.

For example, the third interface device 13 can be selectively associated with the second heating element 22 and the seventh heating element 27. Accordingly, input and output information related to the second 22 and seventh 27 heating elements, which can include, for example, the desired power setting for the heating elements (input) and the current temperature of the heating elements (output), can be respectively inputted and outputted at the third interface device. As stated above, any one or more interface devices 11-14 can be selectively associated with any one or more heating elements 21-28.

Figure 3:
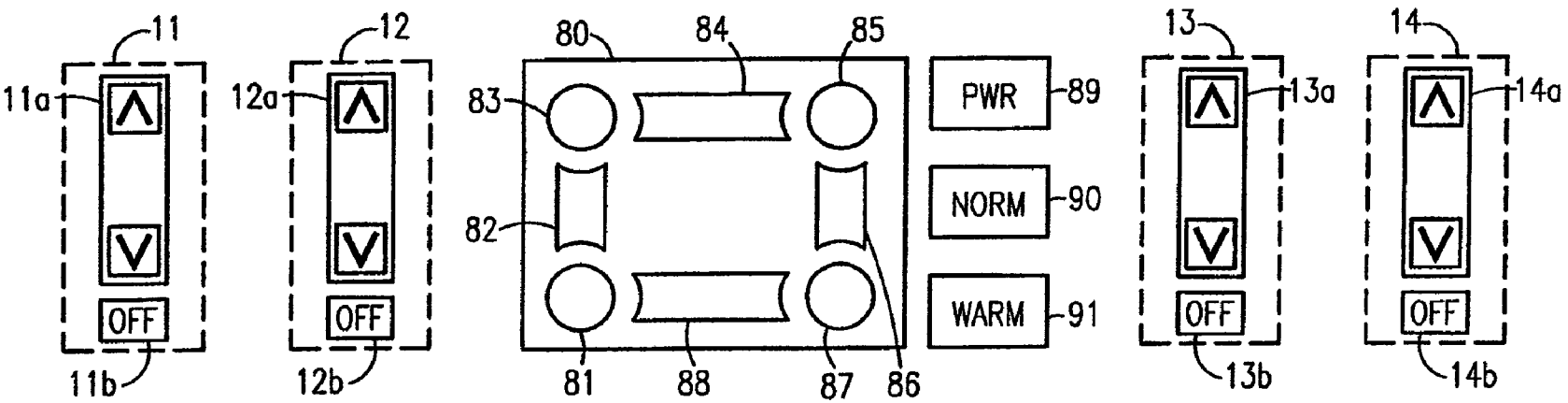
FIG. 3 is an example control interface for heating elements.

The selective association of the interface devices 11-14 with the heating the elements 21-28 performed by the interface controller 15 can be based on user-inputted information. FIG. 3 shows an example control interface for cooktop heating elements, which provides for the selective association of the interface devices 11-14 with the heating elements 21-28 (see FIG. 1) by a user. Each interface device 11-14 includes a heating element temperature input 11*a*-14*a* for inputting a heating element power setting and an off switch 11*b*-14*b* for turning off an associated heating element or elements.

In addition to the interface devices 11-14, the control interface of FIG. 3 includes the interactive display 80. In an example embodiment, the interactive display 80 includes graphical icons 81-88 that graphically represent the heating elements 21-28, respectively. The layout of the graphical icons 81-88 mimics the layout of the heating elements 21-28. The interactive display 80 can receive user selections as inputs and provide information to the user, either graphically or via displayed text. The control interface further includes a power switch 89, a normal switch 90 for selecting a normal heating profile and a warm switch 91 for selecting a warm heating profile. Although not shown on the schematic power control system of FIG. 1, it is to be appreciated that the power switch 89, the normal switch 90, and the warm switch 91 can be monitored by the interface controller 15 as inputs.

The user can input an arbitrarily selected control configuration for the heating elements 21-28 via the interactive display 80, either via the interactive display 80 alone or in conjunction with the interface devices 11-14. The interface controller 15 (see FIG. 1) will selectively associate the interface devices 11-14 with the heating elements 21-28 based on the user's arbitrarily selected configuration. In an example embodiment, the user selects one or more of the heating elements 21-28 by selecting corresponding graphical icons 81-88 on the interactive display 80. For example, the user could select the second heating element 22 by touching the icon 82, which corresponds to the second heating element 22, and the seventh heating element 27 by touching the icon 87, which corresponds to the seventh heating element 27. The interactive display 80 provides the user with an indication of his selections by, for example, highlighting the selections or illuminating LEDs associated with the graphical icons 81-88.

After the user has selected one or more of the heating elements 21-28 via the associated graphical icons 81-88, the user selects one or more of the interface devices 11-14 to be associated with the selected heating elements 21-28. The user can select a particular user interface device by touching the device. Selected graphical icons 81-88 and interface devices 11-14 can be deselected by touching them a second time. Once one or more selections have been made, the user touches a designated input switch, such as the power switch 89, or a dedicated icon on the interactive display. The interface controller 15 then associates the selected heating elements 21-28, which are represented by the selected graphical icons 81-88, with the selected interface devices 11-14, so that the selected interface devices control the selected heating elements and output information related to the selected heating elements is provided at the selected interface devices. In an embodiment, a heating profile can also be arbitrarily selectively associated with the heating elements 21-28.

Instead of or in addition to displaying the graphical icons 81-88, the interactive display 80 can display a menu having a plurality of user selectable heating element control configurations. The user can choose an association of heating elements 21-28 with interface devices 11-14 from the selectable configurations provided by the menu. The menu can include a default heating element control configuration and multiple additional configurations. The user can change the default heating element control configuration and the additional configurations, if desired.

Once the arbitrarily selected heating elements have been associated with the arbitrarily selected interface devices, thereby establishing a current heating element control configuration, the interface controller 15 can save the current configuration in a memory, such as a non-volatile memory. The current heating element control configuration is then available for use in subsequent cooking operations, and can be used as a default configuration in subsequent cooking operations.

In an embodiment, the interactive display 80 and/or the interface devices 11-14 provide a common indication of a selective association of one or more of the heating elements 21-28 with one or more of the interface devices 11-14. An example of a common indication is a common color indication. For example, if the third interface device 13 is selectively associated with the second heating element 22 and the seventh heating element 27, the third interface device 13 and the graphical icons that represent the second and seventh heating elements 82, 87 can be highlighted in a common color, such as yellow. Additional heating element and interface device associations can be indicated by additional colors. Highlighting can be achieved, for example, by illuminating an interface device with colored light or changing the color of a graphical icon, or by illuminating a perimeter area around the interface device or icon in a particular color, or by illuminating an area near the interface device or icon in the particular color. Highlighting can be achieved through the use of colored LEDs, for example. It will be understood that the current invention is not limited to a particular method of highlighting.

By indicating the selective associations of interface devices with heating elements via common color indications, the selective associations will be readily apparent to the user. In the example described above, the user would realize that the third interface device 13 is selectively associated with the second heating element 22 and the seventh heating element 27 by perceiving that the third interface device 13 and the graphical icons 82, 87 are highlighted in the common color yellow.

In addition to common color indications, other common indications for indicating selective associations of heating elements and user interface devices are within the scope of the invention, such as common flashing light indications, for example. Other example common indications include common symbol indications in which common symbols are displayed on or near associated heating element graphical icons and interface devices, common crosshatching indications, common numbering indications, interconnected lines for indicating selective associations, and the like.

The interface controller 15 is programmed to perform the above-described selective associations and does not need to be reprogrammed in order to change the association of interface devices 11-14 and heating elements 21-28.

According to one aspect of the present invention, any one or more interface devices 11-14 can be selectively associated with any two or more of the heating elements 21-28. According to another aspect of the present invention, any one or more interface devices 11-14 can be selectively associated with any three or more of the heating elements 21-28. According to another aspect of the present invention, any one or more interface devices 11-14 can be selectively associated with any four or more of the heating elements 21-28. According to another aspect of the present invention, any one or more interface devices 11-14 can be selectively associated with any five or more of the heating elements 21-28. According to another aspect of the present invention, any one or more interface devices 11-14 can be selectively associated with any six or more of the heating elements 21-28. According to another aspect of the present invention, any one or more interface devices 11-14 can be selectively associated with any seven or more of the heating elements 21-28. According to another aspect of the present invention, any one or more interface devices 11-14 can be selectively associated with all eight of the heating elements 21-28. It will be understood that, as limited by the capabilities of utilized hardware, for example, processor addressing capabilities, any number of interface devices could be selectively associated with any number of heating elements.

According to one aspect of the present invention, any two or more interface devices 11-14 can be selectively associated with any one or more of the heating elements 21-28. According to another aspect of the present invention, any two or more interface devices 11-14 can be selectively associated with any two or more of the heating elements 21-28. According to another aspect of the present invention, any two or more interface devices 11-14 can be selectively associated with any three or more of the heating elements 21-28. According to another aspect of the present invention, any two or more interface devices 11-14 can be selectively associated with any four or more of the heating elements 21-28. According to another aspect of the present invention, any two or more interface devices 11-14 can be selectively associated with any five or more of the heating elements 21-28. According to another aspect of the present invention, any two or more interface devices 11-14 can be selectively associated with any six or more of the heating elements 21-28. According to another aspect of the present invention, any two or more interface devices 11-14 can be selectively associated with any seven or more of the heating elements 21-28. According to another aspect of the present invention, any two or more interface devices 11-14 can be selectively associated with all eight of the heating elements 21-28.

According to one aspect of the present invention, any three or more interface devices 11-14 can be selectively associated with any one or more of the heating elements 21-28. According to another aspect of the present invention, any three or more interface devices 11-14 can be selectively associated with any two or more of the heating elements 21-28. According to another aspect of the present invention, any three or more interface devices 11-14 can be selectively associated with any three or more of the heating elements 21-28. According to another aspect of the present invention, any three or more interface devices 11-14 can be selectively associated with any four or more of the heating elements 21-28. According to another aspect of the present invention, any three or more interface devices 11-14 can be selectively associated with any five or more of the heating elements 21-28. According to another aspect of the present invention, any three or more interface devices 11-14 can be selectively associated with any six or more of the heating elements 21-28. According to another aspect of the present invention, any three or more interface devices 11-14 can be selectively associated with any seven or more of the heating elements 21-28. According to another aspect of the present invention, any three or more interface devices 11-14 can be selectively associated with all eight of the heating elements 21-28.

According to one aspect of the present invention, all four of the interface devices 11-14 can be selectively associated with any one or more of the heating elements 21-28. According to another aspect of the present invention, all four of the interface devices 11-14 can be selectively associated with any two or more of the heating elements 21-28. According to another aspect of the present invention, all four of the interface devices 11-14 can be selectively associated with any three or more of the heating elements 21-28. According to another aspect of the present invention, all four of the interface devices 11-14 can be selectively associated with any four or more of the heating elements 21-28. According to another aspect of the present invention, all four of the interface devices 11-14 can be selectively associated with any five or more of the heating elements 21-28. According to another aspect of the present invention, all four of the interface devices 11-14 can be selectively associated with any six or more of the heating elements 21-28. According to another aspect of the present invention, all four of the interface devices 11-14 can be selectively associated with any seven or more of the heating elements 21-28. According to another aspect of the present invention, all four of the interface devices 11-14 can be selectively associated with all eight of the heating elements 21-28.

In one embodiment of the present invention, the power control system includes means for sensing the presence of a cooking receptacle at any one or more of the heating elements 21-28. The terms "cooking receptacle" as used herein refer to a utensil into or onto which food items are placed for cooking, such as a pan, pot, skillet, cooking sheet, or other cooking vessel. The means for sensing the presence of a cooking receptacle may include any structure to accomplish such function. As examples, the means for sensing may include antenna array systems in which a frequency change or disturbance in a received signal can indicate the presence of a cooking receptacle, mechanical systems in which a switch closure or pressure sensor can indicate the presence of a cooking receptacle, rate-of-change systems in which a rate of heat loss can indicate the presence of a cooking receptacle, and metal detector type systems. Such means may include separate structure or may be structure that is within the system that also provides another function. For example, such means could be incorporated into the sensors 41-47 and/or the power unit 31 and/or the controller 15. The inclusion of separate structure to accomplish the function of sensing the presence of a cooking receptacle or the use of existing structure to accomplish the function are not limitations on the present invention.

The means for sensing the presence of a cooking receptacle is monitored by the interface controller 15 as an auxiliary input 52, 53 to the interface controller 15. Alternatively, the means for sensing the presence of a cooking receptacle could be monitored by the power unit 31. The power control system is adapted to permit a power output to a particular heating element 21-28 only when a cooking receptacle is sensed to be present at the particular heating element. It will be appreciated that the power output to any one or more of heating elements 21-28 can be prevented based on the absence of a cooking receptacle at any one or more heating elements 21-28.

The interface controller 15 includes a plurality of auxiliary inputs 52, 53 and auxiliary outputs 54, 55 which can be analog and/or digital inputs and outputs. Examples of auxiliary inputs 52, 53 are contact closure inputs, discrete voltage inputs, for example 5 VDC, and voltage and current signal inputs. Examples of auxiliary outputs 54, 55 are contact closure outputs, for example relay outputs, discrete voltage outputs, for example 5 VDC, and voltage and current signal outputs. The interface controller 15 can monitor the auxiliary inputs 52, 53 and take actions in response to the inputs. For example, the interface controller 15 could monitor a contact closure on a remote fan controller, indicating a fan running condition, and display this information on an interface device 11-14. In a further example, the interface controller 15 could monitor an ambient temperature through a temperature sensor connected to one of the auxiliary inputs 52, 53 and call for a remote fan or fans to run, via one or more auxiliary outputs 54, 55. In a still further example, a user could call for a remote device to run, for example, a fan, by inputting such a call at one of the interface devices 11-14. The interface controller 15 would receive the call and assert the appropriate auxiliary output 54, 55 to run the fan.

Each of the heating elements 21-28 is separately connected to the power unit 31 so that its power output can be adjusted as required by the user interface controller 15. As described above, switches on the power unit 31 control the power output to the heating elements 21-28. The power unit 31 can vary the level of power provided to each heating element 21-28 by controlling output switches and varying the duty cycle, in terms of the percentage of the time that the heating element is permitted to draw electrical current, of a pulse-width modulated output.

The interface controller 15 can monitor the interface devices 11-14 for the heating element power setting, which would typically be input by the user as a magnitude setting, for example, heat setting 3 (of 10, of 15, of 20, of 25, etc.) or a specific temperature setting, for example 200° Fahrenheit. The interface controller 15 outputs a heating element power level to the power unit 31 based on the heating element power setting. For example, a heating element power setting of 3 could correspond to a heating element power level of 30% duty cycle. In an alternative embodiment, the interface controller 15 outputs the heating element power setting directly to the power unit 31, which converts the heating element power setting to the heating element power level.

Multiple heating profiles may be programmed into the interface controller 15, or, alternatively, into the power unit 31, which allow a heating element power setting to correspond to multiple heating element power levels. For example, in a low temperature operation, such as a "simmer mode," all of the available heating element power settings could correspond to low duty cycle heating element power levels (for example, less than 50% duty cycle). In a high temperature operation, all of the available heating element power settings could correspond to high duty cycle heating element power levels (for example, greater than 50% duty cycle). It is to be appreciated that various other profiles could be provided, including specialty settings such as wok or grilling settings. Multiple heating profiles could thus be provided. The heating profile selection can be based upon a user input at an interface device 11-14, upon the state of an auxiliary input 52, 53, or upon a programmed control algorithm. Also, it is to be appreciated that because of the ability to program, various additional aspects can be controlled or provided, such as star-K compliance (e.g., delay start time), demo mode (e.g., operation without actual heating of the elements), cook-top lockout (e.g., maintenance of non-heating of the elements), etc.

Each of following tables provides an example of a unique heating profile. Ten heating element power settings and corresponding power levels are provided in each example heating profile. It will be understood that the current invention is not limited to heating profiles including ten heating element power settings and corresponding power levels, and that the scope of the invention includes heating profiles including fewer and greater than ten heating element power settings and levels. Similarly, the current invention is not limited four heating profiles, and that the scope of the invention includes greater and less than four heating profiles. From the example heating profiles below, it will be apparent that the relationship between heating element power settings and corresponding power levels can be either linear or non-linear.

TABLE 1

| Example Heating Profile No. 1 | |
|---|---|
| Power Setting | Power Level (Duty Cycle %) |
| 1 | 10 |
| 2 | 20 |
| 3 | 30 |
| 4 | 40 |
| 5 | 50 |
| 6 | 60 |
| 7 | 70 |
| 8 | 80 |
| 9 | 90 |
| 10 | 100 |

TABLE 2

| Example Heating Profile No. 2 | |
|---|---|
| Power Setting | Power Level (Duty Cycle %) |
| 1 | 4 |
| 2 | 8 |
| 3 | 12 |
| 4 | 16 |
| 5 | 20 |
| 6 | 24 |
| 7 | 28 |
| 8 | 32 |

TABLE 2-continued

| Example Heating Profile No. 2 | |
|---|---|
| Power Setting | Power Level (Duty Cycle %) |
| 9 | 36 |
| 10 | 40 |

TABLE 3

| Example Heating Profile No. 3 | |
|---|---|
| Power Setting | Power Level (Duty Cycle %) |
| 1 | 50 |
| 2 | 51 |
| 3 | 53 |
| 4 | 55 |
| 5 | 57 |
| 6 | 62 |
| 7 | 70 |
| 8 | 80 |
| 9 | 90 |
| 10 | 100 |

TABLE 4

| Example Heating Profile No. 4 | |
|---|---|
| Power Setting | Power Level (Duty Cycle %) |
| 1 | 2 |
| 2 | 5 |
| 3 | 9 |
| 4 | 15 |
| 5 | 25 |
| 6 | 37 |
| 7 | 50 |
| 8 | 65 |
| 9 | 80 |
| 10 | 100 |

The power unit 31 monitors the temperature of the heating elements 21-28 via the temperature sensors 41-48. This allows the interface controller 15 and/or power unit 31 to perform closed-loop or feedback temperature control of the heating elements, for example proportional-integral-derivative (PID) control. Multiple heating profiles may be programmed into the interface controller 15, or, alternatively, into the power unit 31, which allow the heating element power settings to correspond to multiple heating element power levels, wherein the power levels correspond to specific heating element temperatures, rather than duty cycle percentages as described above.

Figure 2:
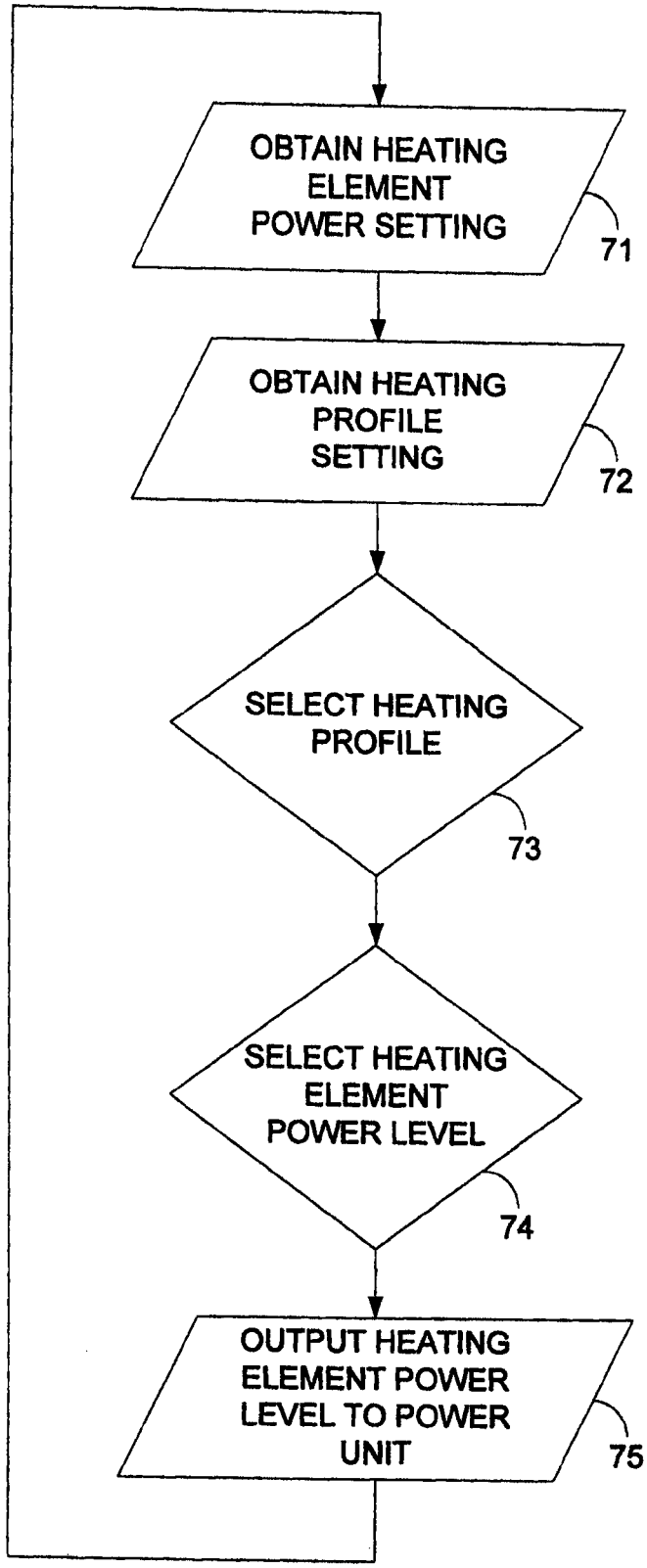
FIG. 2 is a flowchart showing a method of controlling power to cooktop heating elements involving multiple heating profiles.

A method of controlling power to heating elements involving multiple heating profiles will now be described. Referring to FIG. 2, at step 71 heating element power settings are obtained. Heating element power settings are typically provided by the user at the interface devices 11-14. However, heating element power settings could also be generated by the interface controller 15 itself according to a control algorithm, or by another controller, for example, an oven controller 51 or power unit 31.

At step 72, a heating profile setting is obtained. The heating profile setting can be based upon a user input at an interface device 11-14, upon the state of an auxiliary input 52, 53, or upon a programmed control algorithm. After the heating profile setting is obtained, as shown in step 73, the corresponding heating profile is selected from the one or more programmed heating profiles. The power control system can be delivered to the user with multiple heating profiles pre-programmed and/or the heating profiles can be user-definable.

As shown in step 74, the heating element power level that corresponds to the heating element power setting is selected from the chosen heating profile. The selected heating element power level is then outputted to the power unit 31 for control of the appropriate heating element or elements, as shown in step 75.

The power control system can be provided on a cooking device including a range and an oven, wherein power distribution to the oven is controlled by the oven controller 51. The oven controller can communicate with the interface controller 15 and power unit 31, which allows for the coordinated control of oven heating elements and cooktop heating elements.

It should be evident that this disclosure is by way of example and that various changes may be made by adding, modifying or eliminating details without departing from the fair scope of the teaching contained in this disclosure. For example, a different number of interface devices may be provided, a different number of heating devices may be provided, and/or a different number of elements per heater may be provided. The invention is therefore not limited to particular details of this disclosure except to the extent that the following claims are necessarily so limited.

What is claimed is:

1. A cooking appliance, comprising:

a plurality of heating elements;

a plurality of user interface devices configured to receive heating element settings; and an input device configured such that a user can arbitrarily selectively associate any one or more of the heating elements with any one or more of the user interface devices, wherein the selected one or more user interface devices remains associated with the selected one or more heating elements throughout a cooking cycle of the selected one or more heating elements, and wherein the plurality of user interface devices are not directly connected to the plurality of heating elements.

2. A cooking appliance as set forth in claim 1, further comprising an indicator that provides a common indication to indicate a selective association of one or more of the heating elements with one or more of the user interface devices.

3. A cooking appliance as set forth in claim 2, wherein the common indication includes at least one of a common color indication, a common numbering indication, a common crosshatching indication, a common symbol indication, a common flashing light indication, and an interconnected line indication.

4. A cooking appliance as set forth in claim 1, wherein the input device includes an interactive display.

5. A cooking appliance as set forth in claim 4, wherein the interactive display provides a common color indication to indicate a selective association of one or more of the heating elements with one or more of the user interface devices.

6. A cooking appliance as set forth in claim 4, wherein the interactive display and the plurality of user interface devices provide a common color indication to indicate a selective association of one or more of the heating elements with one or more of the user interface devices.

7. A cooking appliance as set forth in claim 4, wherein the interactive display includes a graphical icon to indicate a selective association of one or more of the heating elements with one or more of the user interface devices.

8. A cooking appliance as set forth in claim 4, wherein the interactive display is configured to display a selection menu comprising a plurality of user-selectable heating element control configurations.

9. A cooking appliance as set forth in claim 8, wherein the plurality of user-selectable heating element control configurations includes a default configuration.

10. A cooking appliance, comprising:

a first heating element;

a second heating element;

a first user interface device configured to receive a first heating element setting from a user, the first user interface device having a first off switch;

a second user interface device configured to receive a second heating element setting from the user, the second user interface device having a second off switch;

a controller configured to selectively associate any one or both of the first heating element and the second heating element with any one or both of the first user interface device and the second user interface device based on an arbitrary selection by the user; and an indicator configured to indicate a selective association of any one or both of the first element and the second heating element with any one or both of the first user interface device and the second user interface device, wherein the first and second off switches are configured to turn off one or both of the first and second user interface devices based upon the arbitrary selection by the user.

11. A cooking appliance as set forth in claim 10, wherein the first heating element and the second heating element are cooktop heating elements.

12. A cooking appliance as set forth in claim 10, wherein the first heating element is one of a cooktop element, a bake element, a broil element, and a warmer drawer element.

13. A cooking appliance as set forth in claim 10, wherein the indicator provides a common color indication for indicating said selective association.

14. A cooking appliance as set forth in claim 10, wherein the indicator, the first user interface device, and the second user interface device provide a common color indication for indicating said selective association.

15. A cooking appliance as set forth in claim 10, wherein the indicator comprises an interactive display for receiving at least a part of the arbitrary selection by the user.

16. A cooking appliance as set forth in claim 15, wherein the interactive display includes a graphical icon for indicating said selective association.

17. A cooking appliance as set forth in claim 15, wherein the interactive display is configured to display a selection menu comprising a plurality of user-selectable configurations.

18. A cooking appliance as set forth in claim 17, wherein the plurality of user-selectable configurations includes a default configuration.

19. A cooktop heating system, comprising:

a first cooktop heating element;

a second cooktop heating element;

a third cooktop heating element;

a fourth cooktop heating element;

a user interface device configured to receive a heating element setting from a user;

a controller configured to selectively associate the user interface device with any one or more of the first cooktop heating element, the second cooktop heating element, the third cooktop heating element, and the fourth cooktop heating element based on an arbitrary user selection; and an indicator configured to indicate a selective association of the user interface device with any one or more of the first cooktop heating element, the second cooktop heating element, the third cooktop heating element, and the fourth cooktop heating element, wherein the user interface device can be associated with at least two of the first cooktop heating element, the second cooktop heating element, the third cooktop heating element, and the first cooktop heating element such that the at least two selected heating elements can be simultaneously operated via the user interface device.

20. A cooktop heating system as set forth in claim 19, wherein the indicator provides a common color indication for indicating said selective association.

21. A cooktop heating system as set forth in claim 19, wherein the indicator and the user interface device provide a common color indication for indicating said selective association.

22. A cooktop heating system as set forth in claim 19, wherein the indicator comprises an interactive display for receiving at least a part of the arbitrary selection by the user.

23. A cooktop heating system as set forth in claim 22, wherein the interactive display includes a graphical icon for indicating said selective association.

24. A cooktop heating system as set forth in claim 22, wherein the interactive display is configured to display a selection menu comprising a plurality of user-selectable control configurations.

25. A cooktop heating system as set forth in claim 24, wherein the plurality of user-selectable control configurations includes a default configuration.

* * * * *